US006095795A

United States Patent [19]

Potskhishvili et al.

[11] Patent Number: 6,095,795

[45] Date of Patent: Aug. 1, 2000

[54] GAS LIGHTER WITH SAFETY DEVICE

[76] Inventors: David Vakhtangovich Potskhishvili, B. Gruzinskaya, d.40, str. 1, kv 19, g. Moscow 123056, Russian Federation; Karlo Vakhtangovich Potskhishvili, Gldanskiy massiv 11, m.r. k.25, kv. 73, g. Tbilisi 38, 380038, Georgia

[21] Appl. No.: 09/303,615

[22] Filed: May 3, 1999

[51] Int. Cl.[7] ..... F23Q 2/16

[52] U.S. Cl. ..... 431/153; 431/277

[58] Field of Search ..... 431/153, 255, 431/277

[56] References Cited

U.S. PATENT DOCUMENTS

| | | | |
|---|---|---|---|
| 3,820,941 | 6/1974 | Piffath et al. | 431/344 |
| 4,786,248 | 11/1988 | Nitta | 431/153 |
| 4,832,596 | 5/1989 | Morris, Sr. | 431/153 |
| 5,179,870 | 1/1993 | Yang | 431/153 |
| 5,213,495 | 5/1993 | Pan | 431/153 |
| 5,271,731 | 12/1993 | Hsin-Chung | 431/153 |
| 5,676,537 | 10/1997 | Fang | 431/153 |

FOREIGN PATENT DOCUMENTS

| | | |
|---|---|---|
| 0357347 | 3/1990 | European Pat. Off. . |
| 0 482 411 | 4/1992 | European Pat. Off. . |
| 0611096 | 2/1994 | European Pat. Off. . |
| 0 611 096 | 4/1998 | European Pat. Off. . |
| WO 90/00239 | 1/1990 | WIPO . |
| WO 90/12254 | 10/1990 | WIPO . |

OTHER PUBLICATIONS

WO 90/12254, Floriot, F23Q2/16, Child–Proof Gas Lighter, Oct. 1990.

WO 90/00239, Ansquer, F23Q2/16, Jan. 1990.

*Primary Examiner*—Carl D. Price

*Attorney, Agent, or Firm*—McDermott, Will & Emery

[57] ABSTRACT

The present invention relates to the field of energy and concerns a gas lighter with protection from children, i.e. the lighter an ignition mechanism is combined with means for neutralizing this mechanism. According to the first embodiment, the lighter comprises a control lever 6 of the burner valve 2 pressed by a spring and mounted on a platform between side ears in such a way that its axes 9 are disposed in holes of said ears, and said lever is arranged to move vertically and move longitudinally toward the burner valve, the spring which presses the control lever away from the platform is disposed at an angle in direction away from the platform ears, wherein each axis of the control lever is formed at its location in the hole of the side ear with adjacent slopes, wherein an edge of the adjacent slopes is directed toward a gearwheel of ignition means. According to the second embodiment, the control lever is provided with a protrusion received by a hole in the platform, wherein for the first embodiment the hole for receiving axis 9 is a slit consisting of two vertical portions communicating with each other via a horizontal portion, whereas for the second embodiment, the hole for receiving axis 9 is a slit consisting of sequentially disposed vertical and horizontal portions, the horizontal portion being directed toward the burner valve, and for each embodiment in the hole the mating area of walls of the slit horizontal and vertical portions, from the side of the burner valve, is formed as a flat and inclined wall, while all remaining adjacent slit walls are mated with one another at a right angle.

2 Claims, 4 Drawing Sheets

GAS LIGHTER WITH SAFETY DEVICE

BACKGROUND OF INVENTION

This invention relates to the field of energy and concerns a gas lighter with protection from children, i.e. the lighter in which ignition member neutralizing means is provided moveable between a neutralization operating position in which it prevents initiating the ignition mechanism and a position where such s-initiating is allowed, wherein this neutralizing means is moved manually by a lighter user.

Lighters of the above type are known disclosed in WO, No.A-90/00239 and EP, No.A-0357347 where means for controlling the opening of a burner valve consist of a rocking lever pivotally connected to a fixed axis of an orthogonal axis of the burner valve one end of which, in the shape of a horseshoe or a circle, is inserted under a flange of the burner valve while the other end, or the starting end, are intended for a user to initiate the lighter, which user moves it in the direction of the lighter housing overcoming resistance of a spring, while spark deriving means are themselves independent or combined with the lever of the valve opening control, and in which ignition mechanism neutralizing means are normally maintained in a neutralization position and arranged so as to automatically reset into the neutralization position after the ignition mechanism has been initiated.

A lighter of the above type is known, WO, No.A-90/12254, in which ignition mechanism neutralizing means consist of a button disposed under a starting end of a rocking lever, which button is moveable parallel to the longitudinal axis of this rocking lever between an operation position it which this button forms a protrusion with respect to the lever starting end and an unnoticeable position in which it is moves in a direction of the other end of the rocking lever, wherein this button is provided with means for guiding relative the lighter housing.

According to this known technical solution, the button is horseshoe-shaped wherein each end of the horseshoe is made from an elastic material and bears a protrusion, a bulge, typically disposed under a skirt (casing), enclosing the starting end of the rocking lever in order to interfere with this rocking movement in the direction of the valve opening, wherein additional tapering inclined planes are provided on interior edges of sidewalls of the lighter housing and on the button ends in order to cause reduction of the gap from their protrusions when the button moves in a removing direction so as to completely clear the path for the skirt of the rocking lever starting end, whereas the button and the outer rear edge of the skirt of the rocking lever starting end have additional inclined planes of the same inclination capable to cooperate during lowering of this end of the rocking lever to cause movement in the reverse direction of the button into the operating neutralization position. It is easy to conclude that shape complexity of this button (pusher) and additional complexity of this lighter housing upper portion considerably increase its cost.

A lighter is known, U.S. Pat. No. 4,832,596, in which control means for opening a valve comprise a rocking lever pivotally fixed on a motionless axis, orthogonal to a valve burner axis, of which one end is formed as a fork or a circle and inserted under a flange of the burner valve while the other end of which, or the starting end, is designed for a user to initiate the lighter movement, which user pushes it and displaces in a direction of the lighter housing overcoming the force of a back-moving spring, wherein spark deriving means are themselves independent or combined with the valve opening control lever, and wherein the ignition mechanism is coupled to means for neutralizing this mechanism consisting of a member moveable between an operation neutralization position in which said member prevents initiation of the valve opening control lever while having a portion disposed under a rear end activating this lever, and unnoticeably a removal position wherein said member allows this activation, whereby this member is moved manually by the lighter user from the operating neutralization position into a position of neutralization removal and typically is retained in the neutralization position and, moreover, is arranged to be automatically set in the neutralization position after the ignition mechanism has been set in motion.

In this lighter, the moveable displaced member comprises a member slidably forward mounted on an upper edge if its housing, wherein this member is provided with a bent rear end typically located under the rear end activating the control lever, wherein said bent rear end is arranged to move away beyond the rear end which moves the control lever into the neutral position of this member. In this lighter, the forward sliding member is typically retained in the operating position by the back-moving spring and is arranged to move into the neutral position by means of pressure applied to its front end. Accordingly, during ignition of the lighter, it is necessary to hold the forward-moving member in the neutralization position as the control lever is set into motion which is not easy to effect using only one hand. On the other hand, due to the fact that this member is mounted to the side from the lighter head, this forward-moving member runs the risk of being broken or damaged. Finally, its returning into the operating position depends on the presence of its back-moving spring, while it also excessively projects beyond the housing, and there is the risk of its being lost and, consequently, it will cease to function which entails impossibility for the lighter to have the property of a lighter with protection from children.

A gas lighter is known, EP No. A-0611096 having a safety device intended to prevent the possibility for children to light the lighter and comprising a support member fixed on a housing which is a receptacle for liquidified gas, which support member comprises a platform provided with a hole for mounting therein a burner valve for gas emission and provided with side ears with holes, a burner valve control lever mounted on the platform between the side ears and formed at one end together with a fork or circle to enclose with a flange a head of the gas emission burner valve, and with co-axially disposed axes located in the side ear holes, wherein the other end of the control lever, intended to be depressed by a user, is spring-supported with respect to the platform, ignition means, comprising a gearwheel rotatably mounted in the platform ears over the control lever and a flint pressed by a spring toward this gearwheel.

While this lighter is capable to protect itself from the use by children, its complexity of design with respect to availability of a safety device button as an additional complex in implementation design element, reduces its useful life and reliability while enhancing these qualities would reflect on its cost.

A gas lighter is known, U.S. Pat. No. 5,271,731, having a safety device designed to prevent the possibility if children igniting the lighter, said lighter comprising a support portion fixed on a housing being a liquidified gas receptacle, which support portion comprises a platform provided with a hole for mounting a gas emission burner valve and with side ears having holes, a burner valve control lever mounted on the platform between the side ears and formed at one end with a fork or a circle for enclosing with a flange of a head of the gas emission burner valve and with co-axially disposed axes located in the holes of the side ears, the other end of the control lever intended to be depressed by a user is spring-supported relative to the platform, a spring pressing said control lever end from the platform is angled in a direction away form the platform ears, ignition means including a gearwheel rotatably mounted in the platform ears over the control lever, and a flint driven by a spring toward this gearwheel, said control lever being in the side ear holes and arranged to move longitudinally toward the burner valve, the depth of the fork or lever enclosure from the side of the ears being increased by the amount of the longitudinal displacement of the lever in the ear holes.

A disadvantage of the present lighter is that an accidental depressing of the lever in a longitudinal direction causes the lever protrusion to be disengaged from a safety stopping means and the lever protrusion gets into a platform seat. In this position, it is possible to light a flame since the spring bears on the control lever protrusion against the seat walls which impedes self-return of the lever into the blocked position. The lack of blocking of the control lever position in a biased state causes the need for the user's finger to continuously press this lever which decreases convenience of using this lighter.

BRIEF DESCRIPTION OF THE INVENTION

The object of the present invention is to provide a gas lighter with protection against children and having the cost which is much lower than the cost of the above known lighter but which has at least the equivalent safety of operation and a simpler design due to the fact that functions of the safety device, previously relating to a neutralization button, are transferred to the control lever.

Indeed, in a gas lighter according to the first embodiment, intended to prevent the possibility of children igniting the lighter, comprising a support part fixed on a housing being a receptacle for liquidified gas, said support part being a platform provided with a hole for mounting a gas emission burner valve, and having side ears with holes, a burner valve control lever mounted on the platform between the side ears and formed at one end with a fork or enclosure to enclose a head of the gas emission burner valve with a flange, and with co-axially disposed axes located in the holes of said side ears, wherein the other end of the control lever intended to be depressed by a user is pressed by a spring relative to the platform, ignition means including a gearwheel rotatably mounted in the platform ears over the control lever, and a flint pressed by a spring toward this gearwheel, the control lever is mounted in the side ear holes and arranged to move vertically and move longitudinally toward the burner valve, a spring pressing the control lever away from the platform is angled in a direction away from the platform ears, the depth of the fork or enclosure of the lever from the side of the ears is increased by the amount of longitudinal displacement of the lever in the ear holes, wherein each control lever axis is formed on its location in the hole of the side ear with adjacent slopes, an edge of the adjacent slopes being directed toward the gearwheel, wherein in each ear the hole for receiving said axis with the slopes is a slit comprising sequentially disposed first vertical portion, horizontal portion directed toward the burner valve, and second vertical portion, a portion of mating walls of the horizontal and the second vertical slit portions from the side of the burner valve is formed flat and inclined, while all the remaining adjacent walls of the slit are mated with one another at a right angle.

Whereas in a gas lighter according to the second embodiment, intended to prevent the possibility of children igniting the lighter, comprising a support fixed on a housing being a receptacle for liquidified gas, said support part being a platform provided with a hole at one edge for mounting a gas emission burner valve, and with side ears with holes, a burner valve control lever mounted on the platform between the side ears and formed at one end with a fork or enclosure to enclose a head of the gas emission burner valve with a flange, and with co-axially disposed axes located in the holes of said side ears, wherein the other end of the control lever intended to be depressed by a user is pressed by a spring relative to the platform and is provided with a protrusion directed toward the platform, ignition means including a gearwheel rotatable mounted in the platform ears over the control lever, and a flint pressed by a spring toward this gearwheel, wherein the other edge of the platform is provided with a hole for receiving the protrusion of said lever when it is pressed by the user, the control lever is mounted in the holes of the side ears and arranged to move vertically and move longitudinally toward the burner valve, a spring pressing the control lever away from the platform is angled in a direction away from the platform ears, the hole in the platform for receiving the lever protrusion is biased relative to said protrusion toward the platform ears by the amount of longitudinal displacement of the lever in the ear holes, the depth of the fork or enclosure of the lever from the side of the ears is increased by the amount of longitudinal displacement of the lever in the ear holes, the height of the protrusion is equal to the distance from the lower plane of the lever to the platform plane, wherein each control lever axis is formed on its location in the hole of the side ear with adjacent slopes, an edge of the adjacent slopes being directed toward the gearwheel, wherein in each ear the hole for receiving said axis is a slit comprising sequentially disposed vertical portion and horizontal portion directed toward the burner valve, a portion of mating walls of the horizontal and vertical slit portion from the side of the burner valve is flat and inclined, while all the remaining adjacent walls of the slit are mated with each other at a right angle.

DETAILED DESCRIPTION OF THE DRAWINGS

The present invention is illustrated with the following drawings which represent the preferred embodiments according to each version, however, are not unique but demonstrate the possibility to achieve the desired result using totality of essential features provided in the claims.

FIG. 2 shows the lighter of FIG. 1 when a user depresses the control lever and when the safety device is on;

Figure 1:
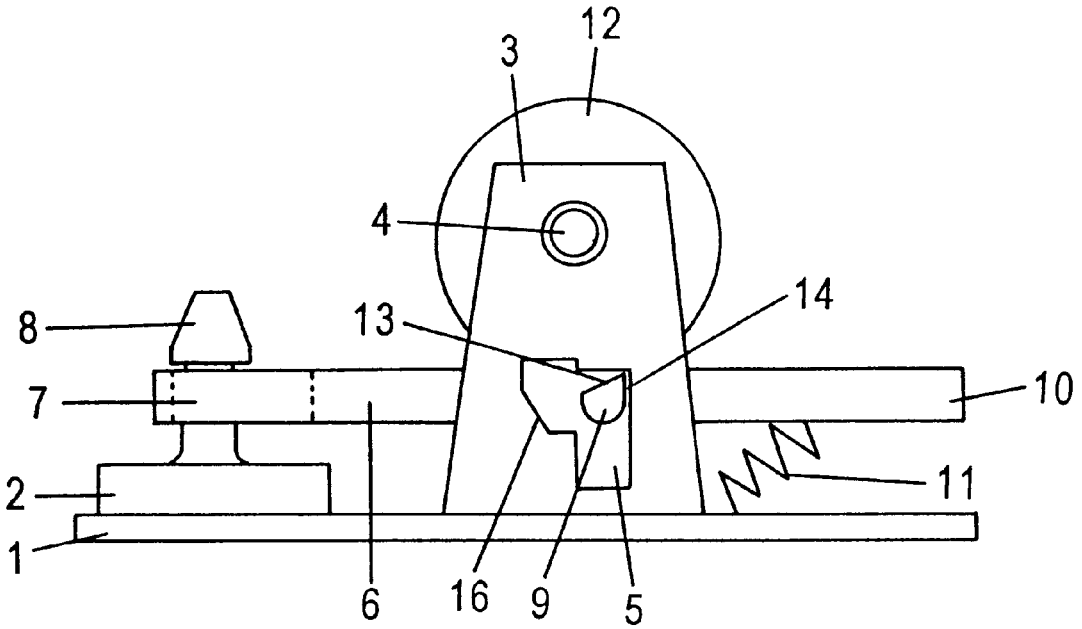
FIG. 1 shows a side view of the lighter according to the first embodiment when the control lever is in its normal position.
Figure 2:
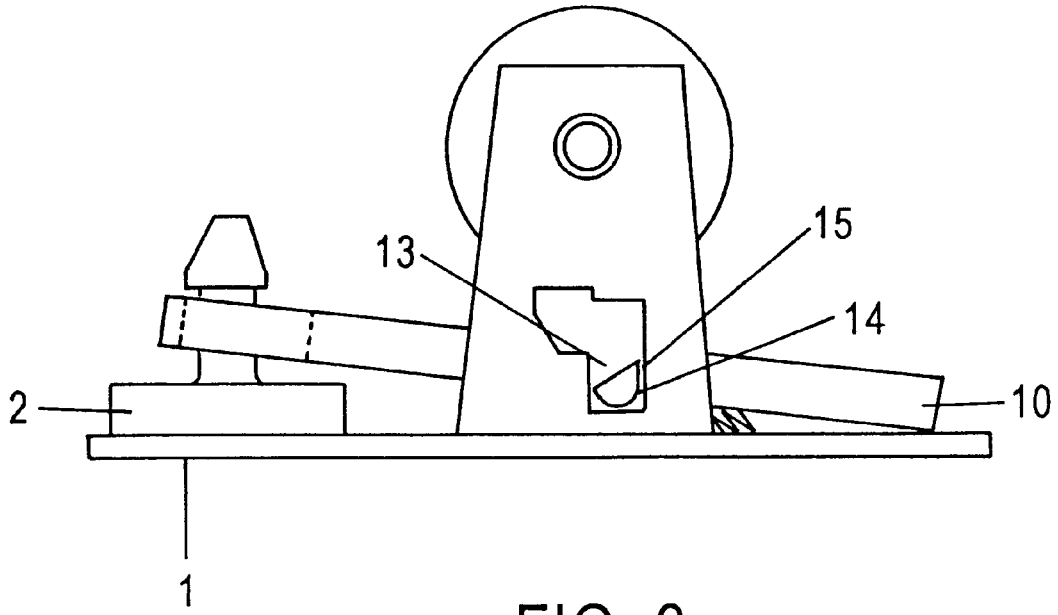
Figure 3:
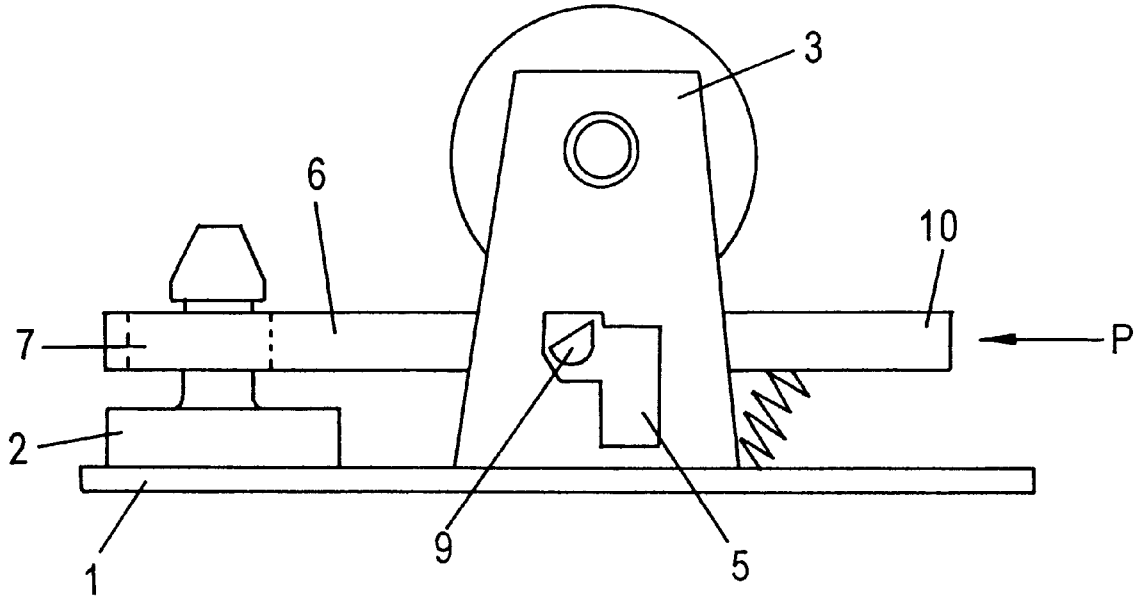
FIG. 3 is a view of the lighter of FIG. 1 upon activation of the safety device.
Figure 4:
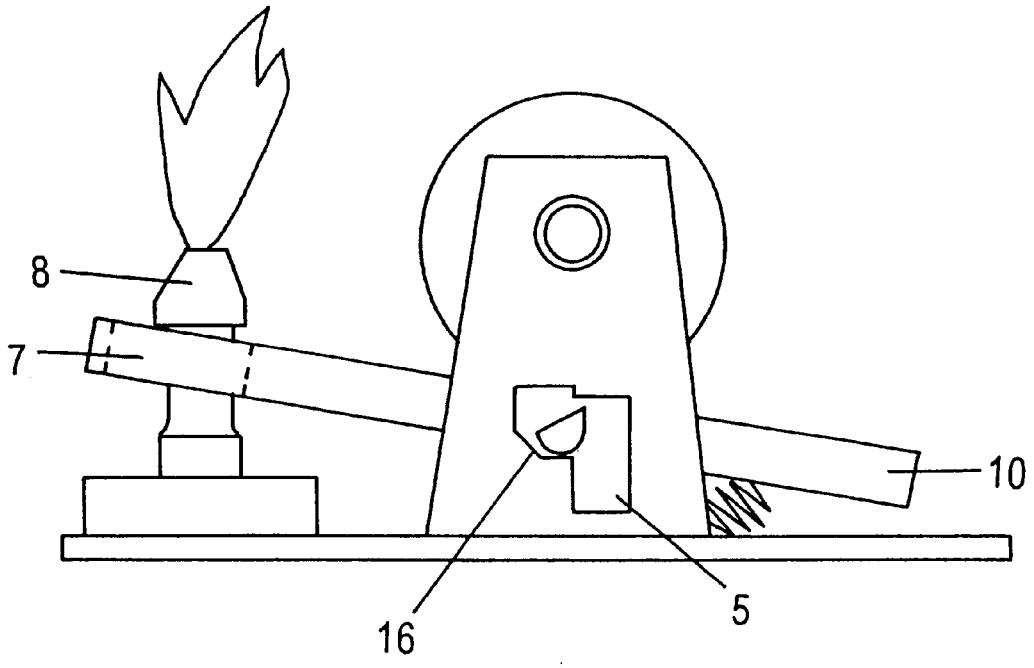
Figure 5:
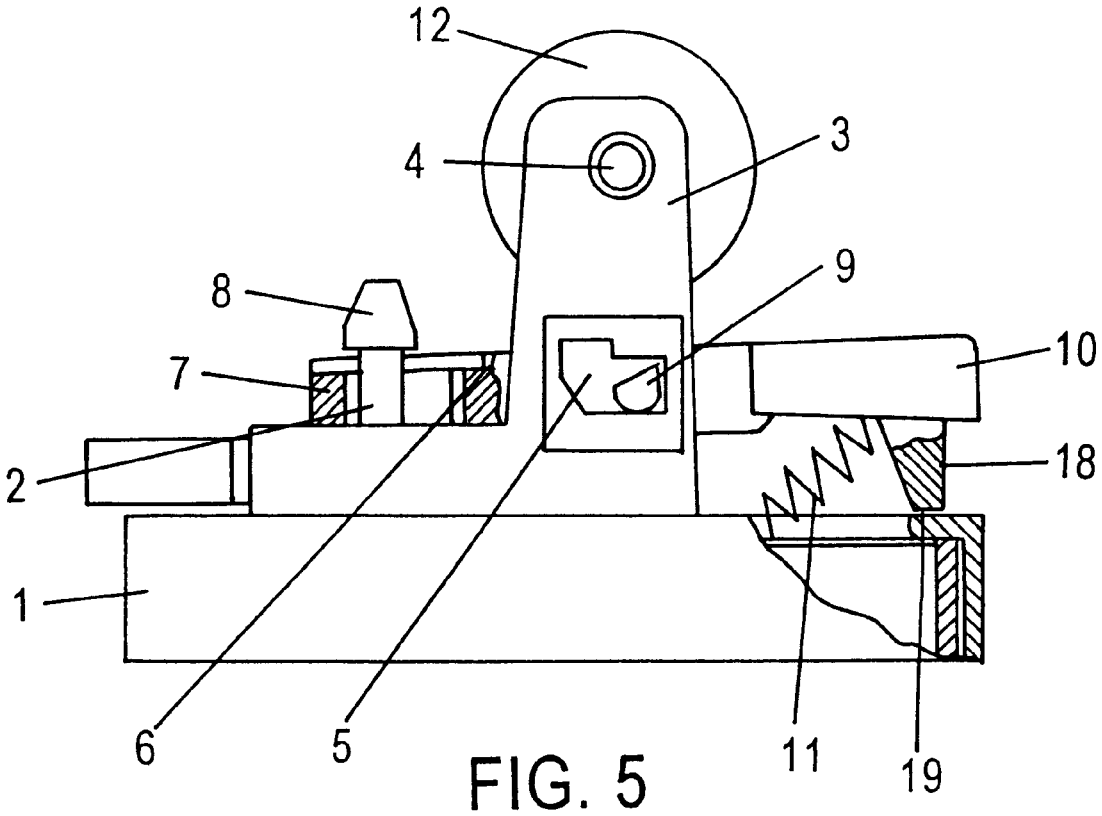

FIG. 4 of the lighter of FIG. 1 when the user depresses the control lever and when the safety device is off;

FIG. 5 shows a side view of the lighter according to the second embodiment when the user depresses the control lever and when the safety device is on.

Figure 6:
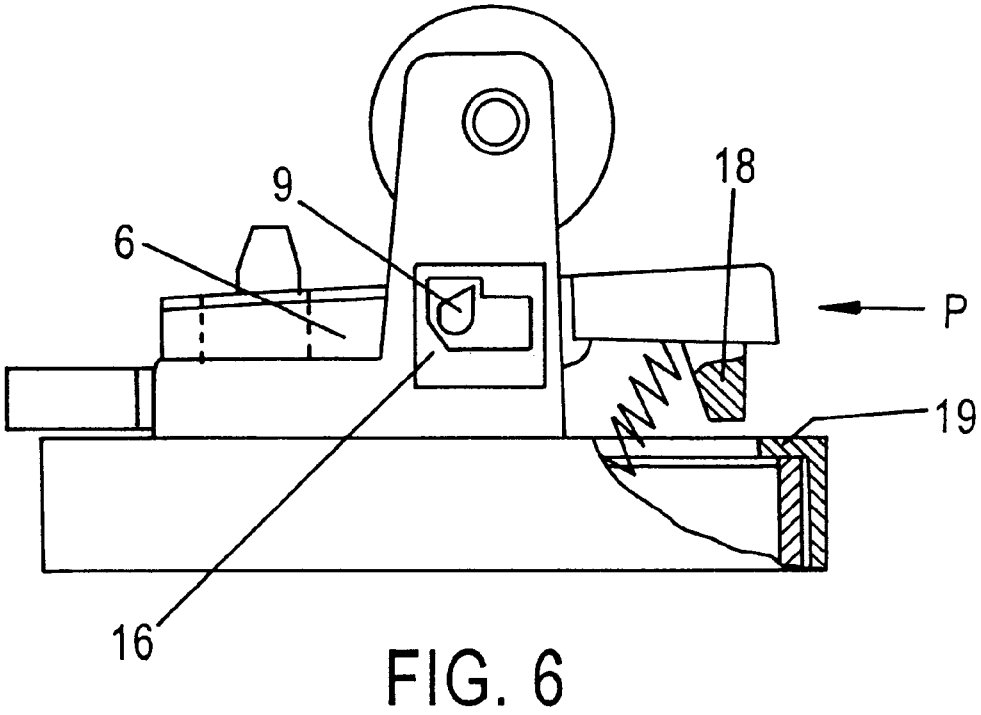
Figure 7:
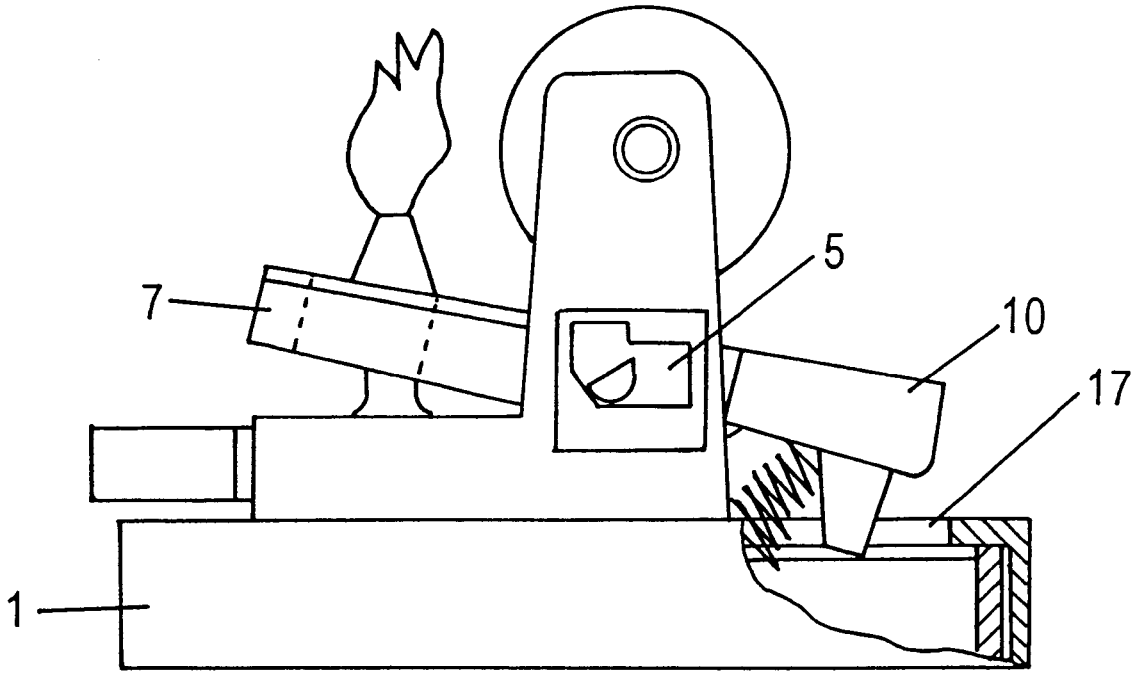

FIG. 6 is a view of the lighter of FIG. 5 upon activation of the safety device; and FIG. 7 is a view of the lighter according to FIG. 5 when the user depresses the control lever and when the safety device is off.

DETAILED DESCRIPTION OF THE INVENTION

As can be seen from FIG. 1 to 4, the lighter according to the first embodiment of the present invention is a gas lighter a hollow housing of which made of a polymeric material is a receptacle for liquidified gas. The housing is closed at the top with a cover being a support part for control mechanism, ignition means and a safety device.

The support part is a platform 1 having a through hole for mounting a gas emission burner valve 2. Platform 1 is provided with side ears 3 having holes 4 and 5.

The control lever 6 for the burner valve 2 is mounted on the platform between side ears. This lever is formed at one end with fork 7 or enclosure for enclosing head 8 of the gas emission burner valve with a flange and with co-axially disposed axes 9 which are located in holes 5 of the side ears. At the same time, the other end 10 of the control lever intended to be depressed by the user is pressed by a spring relative to the platform. Spring 11 pressing the control lever away from the platform is angled away from the platform ears. Preferably, this angle is about 45° so that the control lever in the area of its end 10 is under the action of, respectively, a horizontally applied force from the spring directed away from the platform ears and pressing the lever away from the burner valve and a vertically applied force from the spring pressing the control lever away from the platform. The action of these forces is substantial for the operation of the lighter control mechanism since it causes the automatic resetting of the control lever into the initial blocked position when the user releases end 10.

Ignition means include gearwheel 12 mounted over the control lever and rotatably installed in holes 4 of the platform ears as well as a flint (not shown) pressed by a spring toward this gearwheel. The flint, together with the spring pressing it toward the gearwheel, is mounted on the platform body and is passed through a central opening (not shown) in the control lever.

Control lever 6 is installed in the holes of the side ears and is arranged to move vertically and move longitudinally toward burner valve 2 due to which the depth of fork 7 or enclosure of this lever from the side of the ears is increased by the amount of the longitudinal displacement of the lever in holes 5 of the ears.

Each axis 9 of the control lever is formed at its location in hole 5 of side ear 3 with adjacent slopes 13 and 14, whereby edge 15 of the adjacent slopes is directed toward gearwheel 12. Preferably, the plane of slope 14 must be positioned vertically while the plane of slope 13 must be inclined at an acute angle toward the plane of slope 14.

In each ear 3 hole 5 for receiving axis 9 of control lever 6 comprises a slit consisting of sequentially disposed portions defining the movement path of axis 9 in the vertical and horizontal directions. The first portion is vertical and defines the movement path of axis 9 in the vertical direction upward from the platform. The first portion is in communication with the portion which is horizontally directed toward the burner valve. This portion defines the path of movement of the control lever toward the burner valve. The horizontal portion is in communication with a second vertical portion which defines the movement path of axis 9 upward after it has passed the horizontal portion.

The mating area of the walls of the slit horizontal and second vertical portions from the side of the burner valve is formed as a flat and tilted wall 16 whilst all other adjacent slit walls are mated to one another at a right angle.

The width of the slit defining hole 5 for receiving axis 9 of the control lever is selected not less than the width of the axis so that to provide free movement of the axis along the slit path and to eliminate the wedging effect at the portions when it is not provided for by the control lever operating mode.

The design of axis 9 and hole 5 in the form presented according to the invention allows to provide a safety device with a function of blocking the control lever in initial position thereof which prevents children from using this lighter.

The lighter with protection from children, according to the first embodiment of the invention, operates as follows.

In the initial, or staring, position (FIG. 1), control lever 6 is pressed away of the platform by means of spring 11. At the same time, due to the fact that spring 11 is disposed at an angle of about 45° and its force is directed away from the ears toward end 10 of the control lever, two forces are applied to the lever which constitute acting force of this spring. The first component, directed vertically, pressed the lever upward up to axis 9 abutting the walls of the first vertical portion and horizontal portion in the area of their adjacent angle.

In this initial position, the control lever is neutralized and the possibility to ignite the burner valve by depressing end 10 of the control lever is eliminated.

When the user depresses end 10 of the control lever (FIG. 2), the latter descends downward to abut the platform. At the same time, axis 9 of this lever is also lowered down to abut the bottom horizontal wall of the first vertical slit portion. Turning of lever 6 is effected about head 8 of burner valve 2 which in this case serves as a support. The amount of stroke of axis 9 in the first vertical slit portion is selected on the condition that it must be not less than the amount of stroke of end 10 of the control lever up to its abutting the platform.

In order to eliminate neutralizing the control lever and to provide the possibility of igniting the burner valve when end 10 of the control lever is depressed, it is necessary, in the initial position of the lighter elements, as shown in FIG. 1, by acting on end 10, to apply to it a biasing horizontally directed force P. This force must be directed toward the burner valve. When this force is applied, control lever 6 is displaced toward burner valve 2, wherein there occurs elimination of the gap in fork 7 the amount of which is not less than the amount of the control lever displacement stroke or the amount axis 9 movement stroke at the slit horizontal portion.

When the control lever is displaced, axis 9 moves along the horizontal portion toward the burner valve, reaches the flat and inclined wall 16 of the mating area of the walls of horizontal and second vertical slit portions and rises upward reaching the second vertical slit portion where engages with its edge and one of the slopes the wall of the second vertical portion functioning as a protrusion or a stopping means for the axis.

Upon termination of the acting biasing force P (the user has removed his finger from the lever), the lever remains in this position (FIG. 3), that is in the position when axis 9 is fixed in the second vertical slit portion. Fixing is achieved by the horizontal component of force of spring 11 pressing axis 9 by its vertical slope 14 against the wall of the second vertical slit portion.

To ignite the flame, the user turns gearwheel 12 striking sparks and simultaneously depresses end 10 of the control lever pressing it against the platform. Control lever 6 pivots about axis 9 when it bears against the flat and inclined wall 16 of the mating area of the second vertical and horizontal portions (FIG. 4). The head of the burner valve rises and gas is emitted from the receptacle followed by its ignition.

When the force is removed from end 10 of the control lever, the horizontal component of force exerted by spring 11 pulls the lever back and away from the burner valve, axis 9 which was previously positioned on the inclined and flat wall 16 displaces to abut the vertical wall of the first vertical portion, the lever straightens and all the lighter elements take the initial position illustrated on FIG. 1.

A lighter according to the second embodiment of the present invention is shown in FIGS. 5 to 7 and is also a gas lighter a hollow housing of which made of a polymeric material is a receptacle for liquidified gas. At the top, the housing is closed by a cover being a support part for control mechanism, ignition means and a safety device.

The support part comprises a platform 1 provided with a through hole passing therethrough, formed from one its side and intended for mounting gas emission burner valve 2. Platform 1 is also provided with side ears 3 having holes 4 and 5 and with a through hole 17 from its other side.

Control lever 6 of burner valve 2 is mounted on the platform between the side ears.

This lever is formed at one end with fork 7 or enclosure to enclose with a flange head 8 of the gas emission burner valve and with co-axially disposed axes 9 which are located in holes 5 of the side ears. At the same time, the other end 10 of the control lever intended to be depressed by the user is pressed by a spring relative to the platform. Spring 11 which presses the control lever away from the platform is angled in a direction away from the platform. Preferably, this angle is about 45° so that the control lever in the area of its end 10 is under the action of, respectively, horizontally applied force of the spring directed away from the platform ears and pressing the lever away from the burner valve and of vertically applied force of the spring pressing the lever away from the platform. The action of these forces is essential for operation of lighter control mechanism since it establishes automatic resetting of the control lever into the initial blocked position when end 10 is released by the user.

Control lever 6 from the side of end 10 is provided with a protrusion 18 which is directed toward the platform and the height of which is virtually equal to the distance between the lower plane of the lever and the plane of the platform.

Ignition means include a gearwheel 12 mounted over the control lever and rotatably installed in holes 4 of the platform ears as well as a flint (not shown) pressed by a spring toward this gearwheel. The flint, together with the spring pressing it to the gearwheel, is mounted on the platform body and is passed through a central opening (not shown) in the control lever.

Control lever 6 is mounted in the holes of the side ears and is arranged to move vertically and move longitudinally toward burner valve 2 due to which the depth of fork 7 or enclosure of this lever from the side of the ears is increased by the amount of longitudinal displacement of the lever in holes 5 of the ears (FIG. 5).

Axes 9 of control lever 6 are of the same arrangement as described with respect to the lighter according to the first embodiment thereof.

In each ear 3, hole 5 for receiving axis 9 of control lever 6 comprises a slit consisting of sequentially disposed portions which define the path of movement of axis 9 in horizontal and vertical directions. The first portion is directed horizontally toward the burner valve. This portion defines the movement path of the control lever toward the burner valve. The horizontal portion is in communication with the vertical portion that defines the movement path of axis 9 upward after it has passed the horizontal portion.

The mating area of walls of the horizontal and second vertical portions of the slit, from the side of location of the burner valve, is in the form of a flat and inclined wall 16, and all remaining adjacent slit walls are mated with one another by a right angle.

The width of the slit forming hole 5 for receiving axis 9 of the control lever is selected not less than the axis thickness so as to provide free movement of the axis along the slit path and to eliminate wedging effect at the portions when it is not provided for by the control lever operating mode.

Design of axis 9 and hole 5 as presented according to the invention, enables to provide a safety device with a function of blocking the control lever in its initial position which prevents children from using this lighter.

Hole 17 in the platform for receiving protrusion 18 of the control lever is biases relative to said protrusion toward the platform ears by the amount of longitudinal displacement of the lever in the ear holes. In the initial position, the end of protrusion 18, if depressed, abuts wall 19 confining hole 17. In order for protrusion 18 to fit into hole 17, it is necessary to displace it toward the burner valve by the amount of the stroke of the control lever in the horizontal direction.

The lighter with protection from children according to the second embodiment of this invention operates as follows.

In the initial position (FIG. 5), control lever 6 is pressed by spring 11 away from the platform. At the same time, due to the fact that spring 11 is disposed at an angle of about 45° and its force is directed from the ears to end 10 of the control lever, two forces are applied to the lever constituting acting force of this spring. A first component, directed vertically, presses the lever upward until axis 9 abuts the walls of the horizontal portion.

Stopping means 18 is located outside the area of hole 17, and when means 18 is depressed, the protrusion abuts wall 19.

In this initial position, the control lever is neutralized and the possibility is eliminated for the burner valve to be ignited when end 10 of the control lever is depressed.

When the user depresses end 10 of the control lever, the latter descends downward until the protrusion abuts the platform. In this position, axis 9 of said lever cannot turn. And, consequently, conditions are excluded in which the gas emission valve can open.

In order to eliminate neutralizing of the control lever and provide the possibility of burner valve ignition, it is necessary, in the initial position of the lighter elements, as shown in FIG. 5, by acting on end 10 of the control lever, to apply to it a biasing and horizontally directed force P. This force must be directed toward the burner valve. Once this force is applied, control lever 6 moves toward burner valve 2, whereby in fork 7 is eliminated the gap the amount of which is not less than the amount of stroke of displacement of the control lever or the amount of stroke by which axis 9 moves on the slit horizontal portion.

When the control lever is displaced, axis 9 moves along the horizontal portion toward the burner valve, reaches the flat and inclined wall 16 of the mating area of walls of the horizontal and vertical slit portions and rises upward reaching the vertical slit portion where engages by an edge and one of slopes the vertical portion wall that functions as a protrusion or stopping means for the axis. At the same time, stopping means 18 is also displaced and it finds itself over hole 17.

After cessation of the action of the biasing force P (the user has removed his finger from the lever), the lever remains in this position (FIG. 6), that in the position where axis 9 is fixed in the slit vertical portion. Fixing is achieved by the fact that a horizontal component of the force of spring 11 presses axis 9 by its vertical slope 14 against the wall of the second slit vertical portion.

To ignite the flame, the user turns gearwheel 12 striking sparks and simultaneously depresses end 10 of the control lever pressing it against the platform. Protrusion 18 is received by hole 17. Control lever 6 pivots about axis 9 when in bears against the flat and inclined wall 16 of the mating area of vertical and horizontal portion walls (FIG. 7). The head of the burner valve is raised and gas from the receptacle is released followed by its ignition.

When the force is removed from end 10 of the control lever, the horizontal component of the force exerted by spring 11 pulls the lever back away from the burner valve, axis 9 which was previously on the flat and inclined wall 16, is displaced until it abuts the walls of the horizontal portion, the lever straightens, protrusion 18 exits from hole 17 of the platform, and all the lighter elements take the initial position shown in FIG. 5.

We claim:

1. A gas lighter with safety device intended to prevent the possibility of children igniting the lighter, comprising:

a support part fixed on a housing which is a receptacle for liquefied gas and being a platform with a hole for mounting a gas emission burner valve, and provided with side ears having holes, a control lever of said burner valve formed at one end with a fork to enclose with a flange a head of the gas emission burner valve and rotatably mounted between said ears by means of axles co-axially disposed within the ear holes, another end of the control lever positioned by another side relative to the side ears as compared to the first end and pressed by a spring relative to said platform, a spring pressing said other end of the control lever away from the platform and which is disposed at an angle in a direction away from the platform ears, ignition means including a gearwheel rotatably mounted in said platform ears over the control lever, and a flint spring pressed from the platform toward this gearwheel, said control lever being arranged to move perpendicularly and move longitudinally relative to said platform toward said burner valve, each axle of said control lever being formed with adjacent slopes, wherein an edge of said adjacent slopes is directed toward said gearwheel, in each ear, the hole for receiving said axle with slopes big a slit consisting of a first portion perpendicularly disposed to the platform, an adjacent portion disposed in parallel to the platform and directed toward the burner valve, and an adjacent second portion disposed perpendicularly to the platform, a mating area of the walls of said parallel and second perpendicular slit portions, from the side of said burner valve, being formed as a flat and inclined wall, all remaining adjacent slit walls being mated with one another at a right angle.

2. A gas lighter with safety device intended to prevent the possibility of children igniting the lighter, comprising:

a support part fixed on a housing which is a receptacle for liquidified gas and being a platform with a hole at one edge for mounting a gas emission burner valve, and provided with side ears having holes, a control lever of said burner valve formed at one end with a fork to enclose with a flange a head of the gas emission burner valve and rotatably mounted between the side ears by means of axles co-axially disposed in the ear holes, another end of the control lever positioned on another side relative to the side ears with respect to the first end, pressed by a spring relative to said platform and formed with a protrusion directed toward the platform, a spring pressing said other end of the control lever away from the platform and which is disposed at an angle in a direction away from the platform ears, said is provided, from another edge thereof relative to the burner valve, with a hole for receiving the protrusion of said control lever, when pressed by the user, which is biased relative to said protrusion toward the platform ears by the amount of longitudinal displacement of the lever axles in the ear holes, the height of said protrusion is equal to the distance from the plane of the lever, directed toward the platform to the plane of the platform directed toward it, ignition means including a gearwheel rotatably mounted in said platform ears over the control lever, and a flint spring pressed away from the platform toward this gearwheel, said control lever being arranged to move perpendicularly and move longitudinally toward said burner valve, each axle of said control lever being formed with adjacent slopes, an edge of said adjacent slopes being directed toward the gearwheel, in each ear, the hole for receiving said axle with slopes comprising a slit consisting of a portion perpendicularly disposed to the platform and an adjacent portion disposed in parallel to the platform and directed toward the burner valve, a mating area of the walls of said parallel and said perpendicular slit portions from the side of the burner valve, being formed as a flat and inclined wall, while all remaining adjacent slit walls being mated with one another at a right angle.

* * * * *